US007841108B2

(12) United States Patent
Johnson et al.

(10) Patent No.: US 7,841,108 B2
(45) Date of Patent: Nov. 30, 2010

(54) ARTICLE OF FOOTWEAR WITH VISIBLE INDICIA

(75) Inventors: Daniel A. Johnson, Taichung (TW); Chien-Yu Huang, Yun-Lin Hsien (TW); Hui-Chin Chen, Yun-Lin Hsien (TW)

(73) Assignee: Nike, Inc., Beaverton, OR (US)

( * ) Notice: Subject to any disclaimer, the term of this patent is extended or adjusted under 35 U.S.C. 154(b) by 792 days.

(21) Appl. No.: 11/754,772

(22) Filed: May 29, 2007

(65) Prior Publication Data

US 2008/0295361 A1 Dec. 4, 2008

(51) Int. Cl.
*A43B 23/00* (2006.01)
*A43B 13/18* (2006.01)

(52) U.S. Cl. ..... 36/136; 36/30 R; 36/28

(58) Field of Classification Search ..... 36/136, 36/30 R, 28, 112, 25 R, 8.4
See application file for complete search history.

(56) References Cited

U.S. PATENT DOCUMENTS

| | | | | | |
|---|---|---|---|---|---|
| 2,037,105 | A | | 4/1936 | West | |
| 2,755,567 | A | * | 7/1956 | Rudine | 36/11.5 |
| 4,712,314 | A | * | 12/1987 | Sigoloff | 36/112 |
| 4,845,863 | A | * | 7/1989 | Yung-Mao | 36/114 |
| 5,212,878 | A | | 5/1993 | Burke et al. | |
| 5,222,311 | A | * | 6/1993 | Lin | 36/28 |
| 5,224,278 | A | | 7/1993 | Jeon | |
| 5,513,448 | A | | 5/1996 | Lyons | |
| 5,544,431 | A | | 8/1996 | Dixon | |
| 5,649,374 | A | | 7/1997 | Chou | |
| 5,659,979 | A | * | 8/1997 | Sileo | 36/54 |
| 5,771,606 | A | * | 6/1998 | Litchfield et al. | 36/29 |
| 5,894,683 | A | | 4/1999 | Lin | |
| 6,012,822 | A | | 1/2000 | Robinson | |
| 6,098,313 | A | | 8/2000 | Skaja | |
| 6,539,646 | B2 | * | 4/2003 | Brooks et al. | 36/30 R |
| 6,622,401 | B2 | | 9/2003 | Carroll, III | |
| 6,711,836 | B2 | | 3/2004 | Weiss | |
| 6,751,891 | B2 | | 6/2004 | Lombardino | |
| 6,964,120 | B2 | | 11/2005 | Cartier et al. | |
| 7,003,900 | B2 | | 2/2006 | Trommer | |
| 7,082,698 | B2 | | 8/2006 | Smaldone et al. | |
| 7,100,309 | B2 | | 9/2006 | Smith et al. | |
| 7,159,338 | B2 | | 1/2007 | LeVert et al. | |
| 2002/0050077 | A1 | | 5/2002 | Wang et al. | |
| 2002/0088143 | A1 | | 7/2002 | Brooks et al. | |
| 2003/0110661 | A1 | | 6/2003 | Wu | |
| 2004/0211087 | A1 | | 10/2004 | Scott | |
| 2005/0120592 | A1 | | 6/2005 | Rodriguez | |
| 2006/0174521 | A1 | | 8/2006 | Lee | |
| 2006/0185191 | A1 | | 8/2006 | Crowley | |
| 2006/0283044 | A1 | | 12/2006 | Lacey | |
| 2008/0263894 | A1 | | 10/2008 | Nakano | |

OTHER PUBLICATIONS

International Search Report and Written Opinion, mailed Jun. 4, 2009, from PCT Application No. PCT/US2008/064966.

* cited by examiner

*Primary Examiner*—Ted Kavanaugh
(74) *Attorney, Agent, or Firm*—Plumsea Law Group, LLC

(57) ABSTRACT

An article of footwear with a sole system including a transparent heel portion is disclosed. The transparent heel portion includes a cavity configured to receive a support member comprising a plurality of support columns and an indicia member associated with the support member. The indicia and the support member are both visible along a bottom surface of the heel portion.

20 Claims, 5 Drawing Sheets

ARTICLE OF FOOTWEAR WITH VISIBLE INDICIA

BACKGROUND OF THE INVENTION

1. Field of the Invention

The present invention relates generally to footwear and in particular to an article of footwear including a support member and an indicia member that are visible through a transparent heel portion.

2. Description of Related Art

Articles of footwear with spring-like support members that may be visible through a portion of the heel have been previously disclosed. Chou (U.S. Pat. No. 5,649,374) teaches a sole of a shoe with springs disposed inside a cavity of the heel of the sole. The Chou design is configured to provide an excellent resilience when a user is walking or running. In the Chou design, portions of the inside of the heel of the sole, including the springs, may be visible through window like features in the heel of the sole.

In the Chou design, a plurality of springs are disposed within a retaining bracket that is further associated with a cavity in the heel of the sole. The retaining bracket may be made of a transparent material. The sole may also include several through-holes on the sides and rear of the heel that correspond to protruding blocks of the retaining bracket. Furthermore, on the bottom of the cavity, a semi-transparent sheet may allow a user to view some portions of the cavity from the bottom of the sole.

Lacey (U.S. patent number 2006/0283044) teaches a shoe with a damping element configured to improve the cushioning and damping behavior of the shoe. The damping element is a plate-type base that comprises a plurality of recesses that hold damping parts. The damping element and damping parts are made of plastic. The damping element is removable by sliding the damping element out of a receptacle in the side of the sole of the shoe.

Dixon (U.S. Pat. No. 5,544,431) teaches a shock absorbing shoe with an adjustable insert. Dixon teaches a shoe with a sole with a horizontal aperture that goes through the heel of the sole from one side to the other side. Within the aperture, four springs are positioned vertically to provide cushioning and support. The Dixon design includes clear plastic covers that are positioned over the ends of the aperture on the first side of the heel and the second side of the heel. This configuration allows the springs to be visible along the sides of the heel.

Transparent soles have also been previously proposed. Lee (U.S. patent number 2006/0174521) teaches a shoe that emits light. Lee teaches this shoe to provide a new aesthetic design for a shoe. The shoe includes a transparent sole, including a transparent heel, and a light emitting device. The light emitting device includes several light emitting elements that produce light which may be visible through the transparent sole and heel. It should be noted that the shoe disclosed by Lee is a high-heeled shoe such as a dress shoe and Lee makes no mention of any other type of shoe.

Footwear configured to display indicia have also been proposed. Brooks (U.S. patent number 2002/0088143) teaches a footwear sole with an integral display element on the bottom of the shoe that is intended to prevent the display element from being worn away. The footwear sole is made of two layers, a first layer and a second layer. The first layer is associated with the bottom of the shoe and is made of a semi-transparent material. A second layer is placed on top of the first layer and is positioned closer to a wearer's foot than the first layer. A display element may be integral with the lower surface of the second layer such that the display element is visible through the first layer along the bottom of the shoe. The display element could be made of any material and may illustrate any color and/or pattern.

The prior art has several shortcomings. The soles of the related art generally include small windows for viewing into the sole. There is no teaching of a sole with a transparent heel region, allowing for full visibility of spring-like shock absorbing systems as well as allowing for visibility of additional indicia associated with the shock absorbing systems. There is a need in the art for footwear that solves these problems.

SUMMARY OF THE INVENTION

An article of footwear with a sole system including a transparent heel portion is disclosed. In one aspect, the invention provides an article of footwear, comprising: a support member including a plurality of support columns, the support member being associated with a heel portion of the article of footwear; and where the support member includes an indicia recess configured to receive an indicia member.

In another aspect, the support member includes six support columns.

In another aspect, the support member includes a webbing member configured to attach the support columns together.

In another aspect, the indicia recess is disposed on the webbing member.

In another aspect, the indicia recess is associated with one of the plurality of support columns.

In another aspect, the indicia recess is associated with the webbing member and at least one of the plurality of support columns.

In another aspect, the invention provides an article of footwear, comprising: a sole including a forefoot portion and a heel portion, the heel portion including at least one ground engaging member; a support member including a plurality of support columns disposed within an inner cavity of the heel portion; and where the forefoot portion is substantially opaque and an outer bottom surface and a perimeter wall of the heel portion are substantially transparent.

In another aspect, the support member includes a bottom side.

In another aspect, a substantial majority of the bottom side is visible through the outer bottom surface of the heel portion.

In another aspect, the support member includes a peripheral region including a medial side, a lateral side and a rear side.

In another aspect, a substantial majority of the peripheral region is visible through a periphery of the outer bottom surface of the heel portion.

In another aspect, the heel portion includes a plurality of ground engaging members.

In another aspect, the invention provides an article of footwear, comprising: a sole including a heel portion including an inner cavity and an outer bottom surface that is substantially transparent; the sole further comprising a forefoot portion that is substantially opaque; an indicia member disposed within the inner cavity that is visible through the outer bottom surface; and where the outer bottom surface of the heel portion includes at least one ground engaging member.

In another aspect, the heel portion has a first length and the forefoot portion has a second length.

In another aspect, the first length is greater than the second length.

In another aspect, the indicia member is associated with a support member, the support member including a plurality of support columns and wherein the support member is disposed inside the inner cavity.

In another aspect, the support member includes an indicia recess that is configured to receive the indicia member.

In another aspect, a bottom side of the support member is visible through the outer bottom surface of the heel portion.

In another aspect, the heel portion includes a perimeter wall that is substantially transparent.

In another aspect, a portion of the support member is visible through the perimeter wall.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
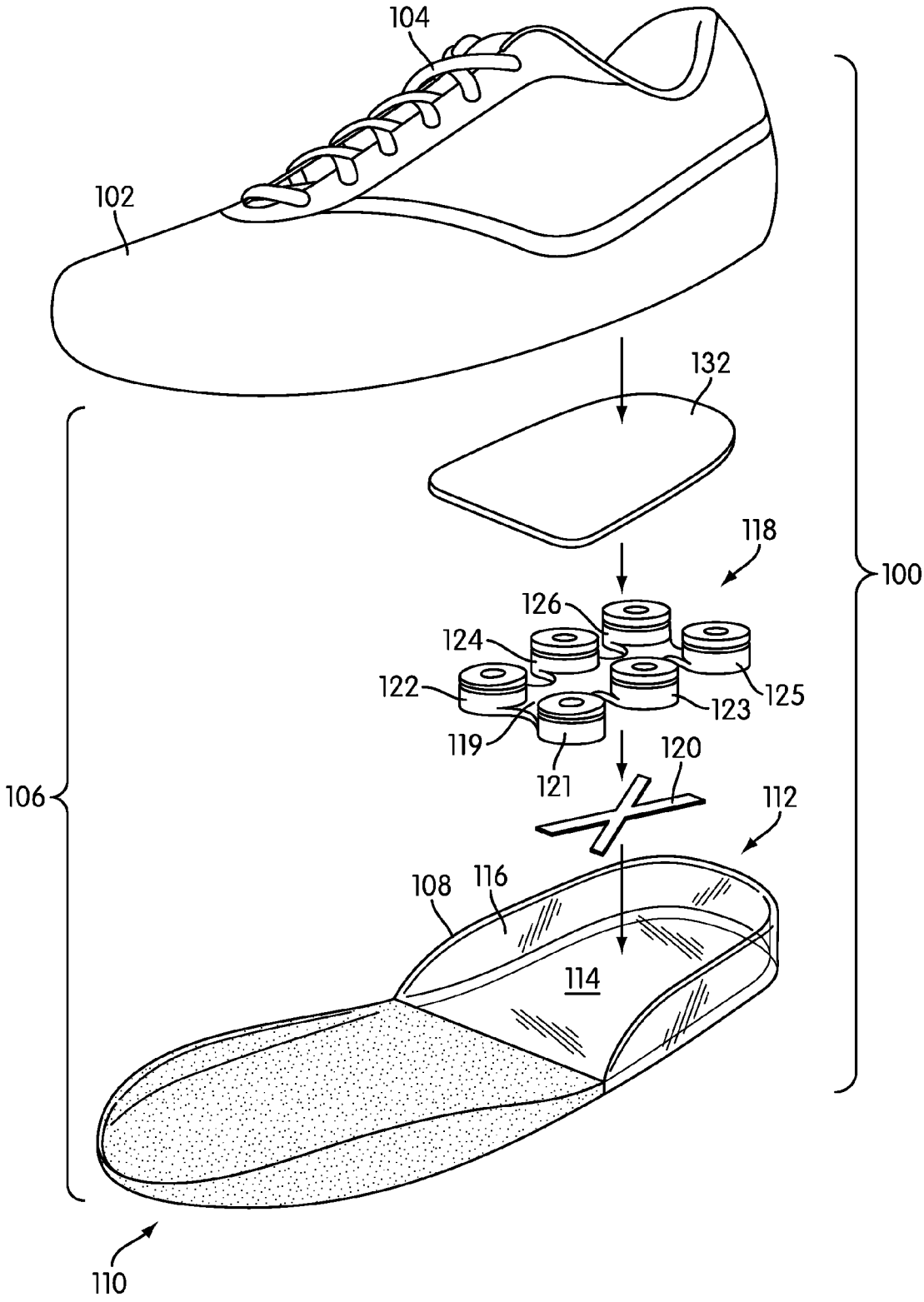
FIG. 1 is an isometric exploded view of a preferred embodiment of an article of footwear.

FIG. 1 is an exploded isometric view of a preferred embodiment of article of footwear 100. In a preferred embodiment, article of footwear 100 may be a running shoe. For clarity, the following detailed description discusses a preferred embodiment, however, it should be kept in mind that the present invention could also take the form of any other kind of footwear including, for example, any type of athletic shoes, boots, as well as other kinds of footwear. As shown throughout the figures, article of footwear 100 is intended to be used with a right foot, however it should be understood that the following discussion may equally apply to a mirror image of article of footwear 100 that is intended for use with a left foot.

Article of footwear 100 may include upper 102. Generally, upper 102 may be made from any material that is suitable for use as an upper. Examples of suitable materials include, but are not limited to, nylon, natural leather, synthetic leather, natural rubber, or synthetic rubber, as well as other materials. Additionally, upper 102 may include fastening system 104. In this embodiment, fastening system 104 is a pair of laces, however in other embodiments a different fastening system may be used such as straps, zippers or other types of fastening systems.

Upper 102 is preferably associated with sole system 106. Sole system 106 may comprise multiple components, including sole 108. Sole 108 preferably comprises forefoot portion 110 and heel portion 112. Forefoot portion 110 is preferably associated with a wearer's forefoot, while heel portion 112 is preferably associated with a wearer's heel and in some cases, the arch of a wearer's foot.

Preferably, sole system 106 includes provisions for absorbing shocks. In this embodiment, sole system 106 may further comprise support member 118. In some embodiments, support member 118 comprises a plurality of support columns. In this embodiment, support member 118 may comprise six support columns, including first support column 121, second support column 122, third support column 123, fourth support column 124, fifth support column 125 and sixth support column 126. Support columns 121-126 are preferably configured to compress during motion, as a wearer's heel steps down. Following this compression, support columns 121-126 preferably return to a fully extended state. In other words, support columns 121-126 may behave similar to springs. Examples of support columns may be found in U.S. Pat. No. 6,964,120, the entirety of which is incorporated here by reference.

In this preferred embodiment, support columns 121-126 generally have a cylindrical geometry. In other embodiments, support columns 121-126 may have features that differ from the current embodiment, including different geometries. In some embodiments, support columns 121-126 may not be cylindrical, with a circular base, but instead may have geometries associated with triangular, square, or other shaped bases. Additionally, the physical dimensions of support columns 121-126 may vary in other embodiments. In some embodiments, support columns 121-126 may include structural features that facilitate their ability to absorb energy. Some features include additional ridges, additional holes, smooth surfaces, indentations as well as other features as disclosed in U.S. Pat. No. 7,100,309, the entirety of which is incorporated by reference.

Support columns 121-126 may be made of shock reducing and/or energy absorbing materials. Preferably, support columns 121-126 may be made of any resilient material, including materials with spring-like properties. Examples of such materials include, but are not limited to, rubber, polyurethane, elastic foams, ethyl-vinyl-acetate (EVA), as well as other materials. In an exemplary embodiment, support columns 121-126 are made of polyurethane foam.

Figure 2:
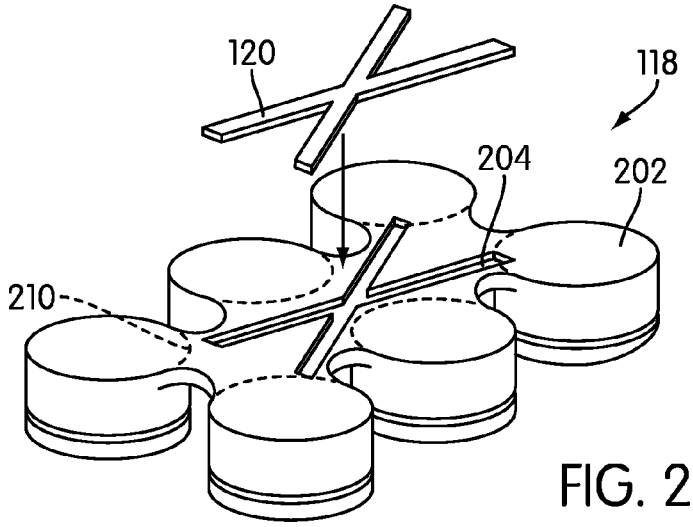
FIG. 2 is an isometric view of a preferred embodiment of a support member configured to receive an indicia member.

Preferably, support member 118 includes provisions for connecting support columns 121-126 to one another. In this current embodiment, support member 118 includes webbing member 119 that is configured to connect to support columns 121-126. Referring to FIGS. 1-2, webbing member 119 is preferably associated with bottom side 202 of support member 118. Preferably, webbing member 119 is integral with support columns 121-126. With this arrangement, support columns 121-126 will not separate from one another. This is preferred since separation of support columns 121-126 could diminish the shock absorbing function of support member 118.

Sole system 106 may be further associated with indicia member 120. Indicia member 120 is preferably a three dimensional indicia of some kind, with a narrow depth relative to the width and length. Indicia member 120 could be any kind of indicia, including, but not limited to, names, numbers, images, symbols or other kinds of indicia. In a preferred embodiment, indicia member 120 may be a logo of some kind.

In some embodiments, sole system 106 may also include heel plate 132. Heel plate 132 may be disposed between support member 118 and upper 112. Using heel plate 132, the stresses applied by a wearer's heel may be distributed evenly across support member 118 and heel portion 112 of sole 108. Generally, heel plate 132 may be made of any material, including rubber, plastic, metal or other types of materials.

FIGS. 2-6 are intended to illustrate the assembly of the various components of sole system 106. While the assembly of sole system 106 with an upper is not discussed in detail, it should be understood that following the assembly of sole system 106, upper 102 may be attached to sole system 106 using any methods known in the art. Furthermore, sole system 106 and upper 102 could be associated with additional layers, such as insoles and mid-soles.

Figure 3:
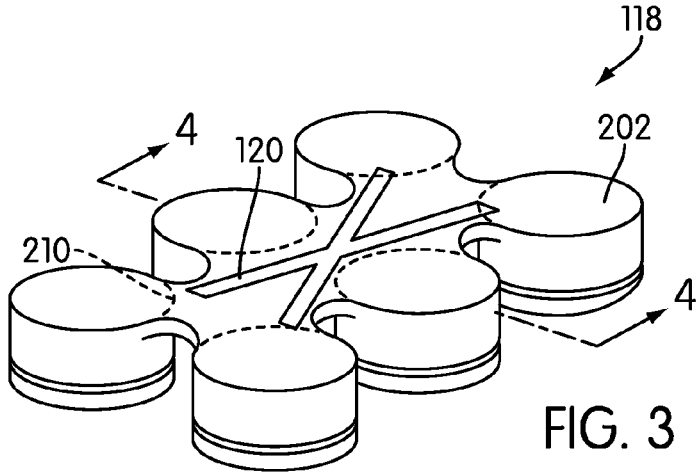
FIG. 3 is an isometric view of a preferred embodiment of a support member and an indicia member.

Referring to FIGS. 2-3, bottom side 202 of support member 118 may include indicia recess 204 that is configured to receive indicia member 120. Preferably, indicia recess 204 has a shape that is substantially identical to the shape of indicia member 120. For purposes of clarity, support column boundaries 210 are illustrated here to distinguish between the regions of bottom side 202 comprising support columns 121-126 and the regions of bottom side 202 comprising just webbing member 119. In this preferred embodiment, indicia recess 204 is disposed within webbing member 119 of support member 118. In particular, indicia recess 204 does not overlap with support columns 121-126 on bottom side 202.

Figure 4:
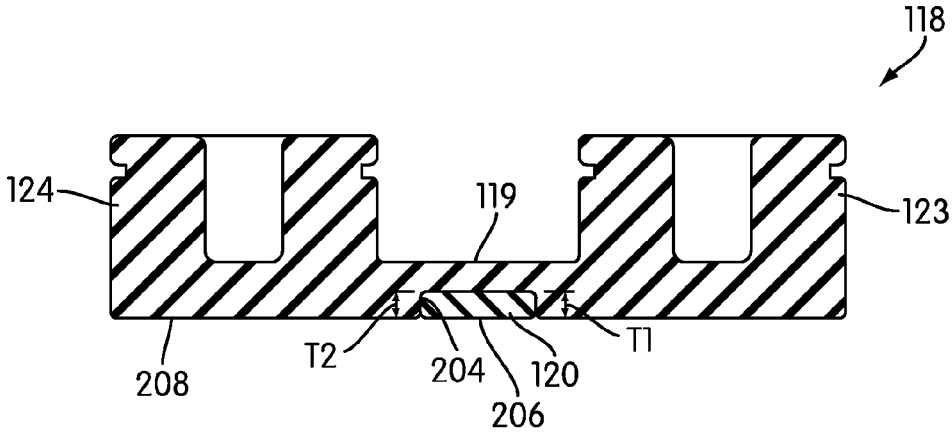
FIG. 4 is a cross sectional view of a preferred embodiment of a support member and an indicia member.

FIG. 4 is a cross sectional view of a preferred embodiment of support member 118. In this embodiment, indicia member 120 is preferably disposed within indicia recess 204 of webbing member 119. In a preferred embodiment, thickness T1 of indicia recess 204 is substantially similar to thickness T2 of indicia member 120. With this preferred arrangement, indicia member 120 may fit within indicia recess 204 in a manner so that first lower surface 206 of indicia member 120 is coincident with second lower surface 208 of support member 118. In other embodiments, thickness T1 of indicia recess 204 could also be larger than thickness T2 of indicia member 120, allowing indicia member 120 to be set back slightly within indicia recess 204. In some embodiments, indicia member 120 may be glued to indicia recess 204 to secure indicia member 120 in place.

In the current embodiment, indicia member 120 is attached to webbing member 119 of support member 118. In other embodiments, however, an indicia could be disposed under a single support column comprising support member 118. In still other embodiments, an indicia member could overlap with both webbing member 119 and various regions of one or more support columns. In other words, indicia member 120 may be disposed on any portion of bottom side 202 of support member 118. Furthermore, it should be understood that while the current embodiment includes only a single indicia member, in other embodiments multiple indicia members could be associated with bottom side 202 of support member 118.

Figure 5:
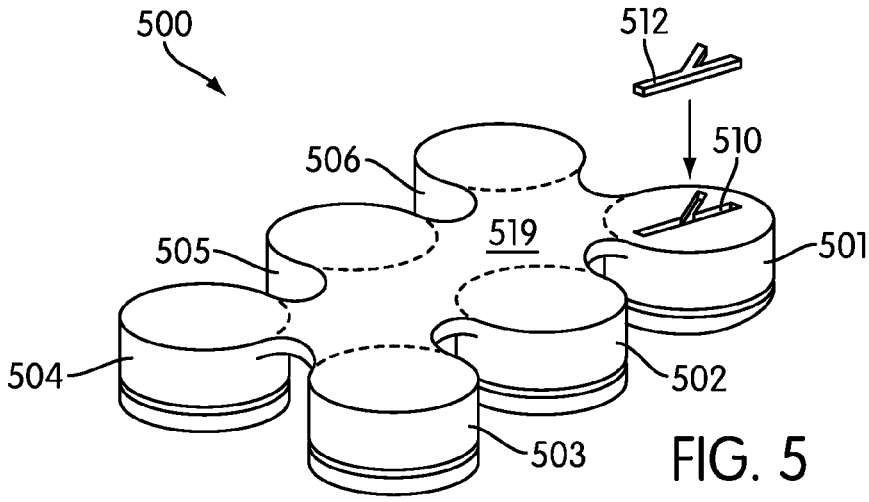
FIG. 5 is an isometric view of a preferred embodiment of a support member and an indicia member.

FIG. 5 is an alternative embodiment of support member 500. Preferably, support member 500 includes first support column 501, second support column 502, third support column 503, fourth support column 504, fifth support column 505 and sixth support column 506. In this alternative embodiment, first support column 501 includes indicia recess 510 that is configured to receive indicia member 512. Preferably, indicia recess 510 is only disposed beneath first support column 501 and does not extend to webbing member 519 or other support columns.

Referring back to the preferred embodiment, after indicia member 120 has been assembled with support member 118, support member 118 may be further associated with heel portion 112 of sole 108, as seen in FIG. 1. Preferably, heel portion 112 includes cavity 114 that is formed by perimeter wall 116 of heel portion 112. In some embodiments, cavity 114 may be configured to receive support member 118 with indicia member 120.

Figure 6:
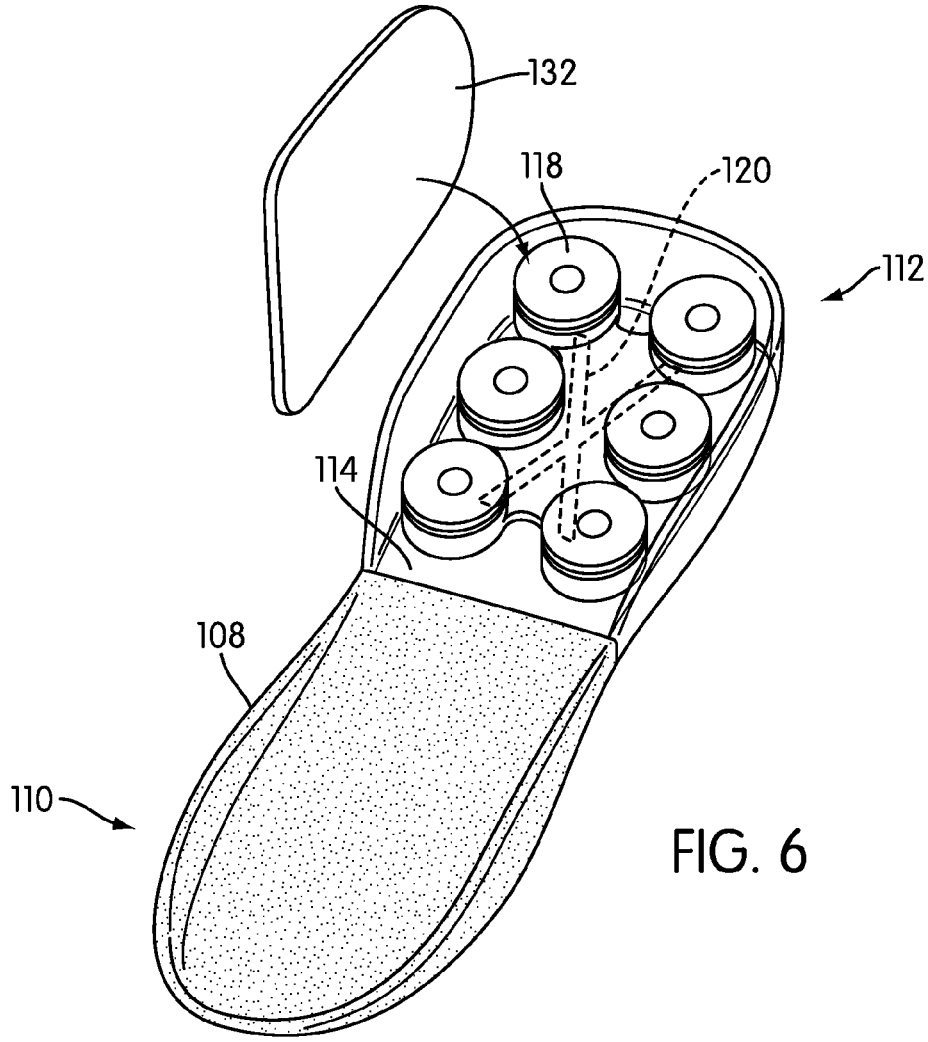
FIG. 6 is a top down view of a preferred embodiment of a sole being assembled.

FIG. 6 illustrates a preferred embodiment of sole 108, with support member 118 disposed within cavity 114. Indicia member 120 is shown in phantom, as it is disposed beneath support member 118 in this embodiment. Once support member 118 has been placed within cavity 114, heel plate 132 may be placed over heel portion 112. In some embodiments, support member 118 may be glued within cavity 114 or fixed in place using another type of adhesive. Likewise, heel plate 132 may be attached to heel portion 112 using glue or another type of adhesive. With this preferred arrangement, support member 118 and indicia member 120 may be sealed within cavity 114.

This configuration may also allow for increased structural stability of sole 108. In particular, perimeter wall 116 of heel portion 112 may provide additional stability to sole 108 over sole systems that only include a support member with no perimeter wall. As a wearer steps down on heel plate 132, stresses may be applied evenly to support member 118, as well as over perimeter wall 116, which may increase the stability of sole 108.

Preferably, sole system 106 includes provisions for viewing support member 118 and indicia member 120 after article of footwear 100 has been assembled. In this preferred embodiment, heel portion 112 may be made of a substantially transparent material, while forefoot portion 110 may be made of a substantially opaque material. This preferred arrangement allows support member 118 and indicia member 120 to be visible from within cavity 114 of heel portion 112.

Figure 7:
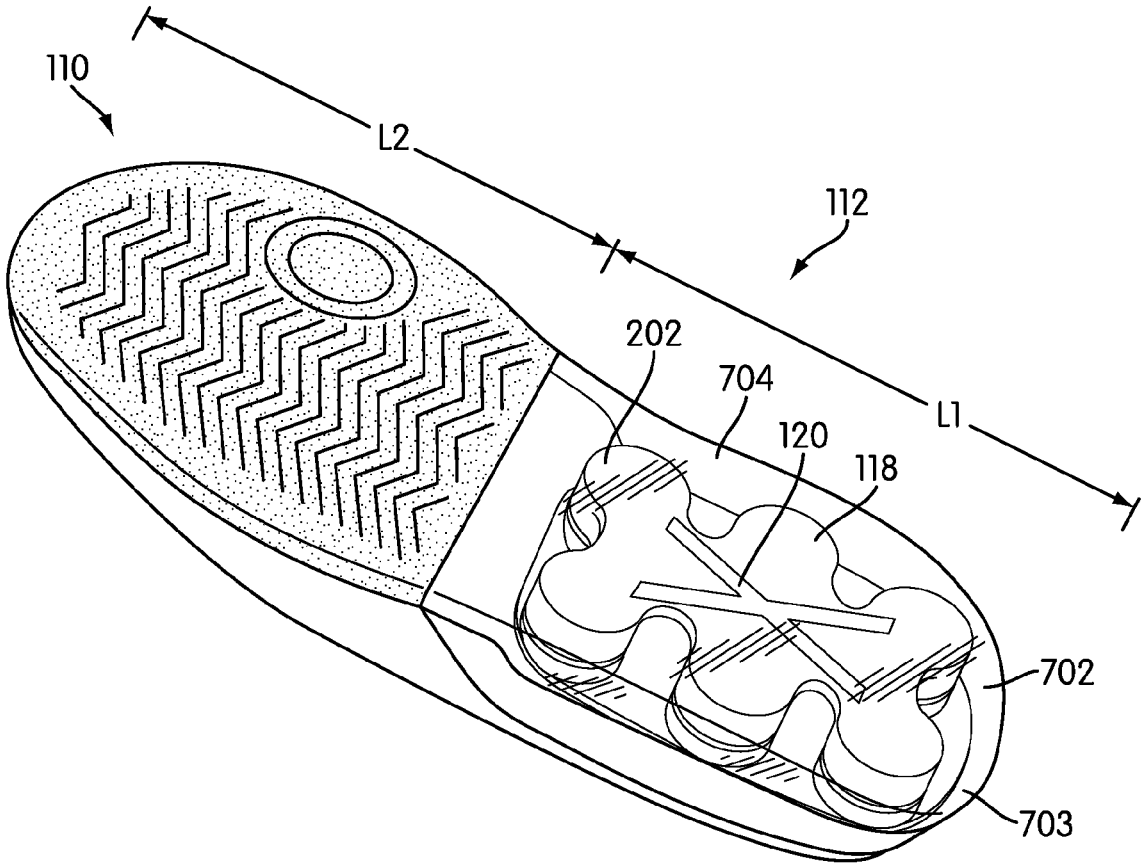
FIG. 7 is an isometric view of a preferred embodiment of the bottom surface of a sole.

Referring to FIG. 7, support member 118 is preferably visible through outer bottom surface 702 of heel bottom 703. Additionally, indicia member 120, which is pressed into bottom side 202 of support member 118, is also preferably visible through outer bottom surface 702 of heel portion 112. From this view it is clear that periphery 704 of outer bottom surface 702 is also substantially transparent. In this preferred embodiment, heel portion 112 has a length L1 that is generally larger than length L2 associated with forefoot portion 110. In other words, a substantial majority of the bottom of sole 108 is transparent.

Figure 8:
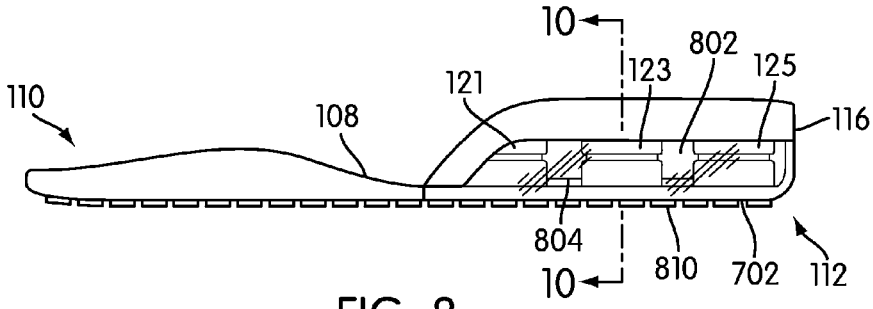
FIG. 8 is a schematic side view of a preferred embodiment of a sole.
Figure 9:
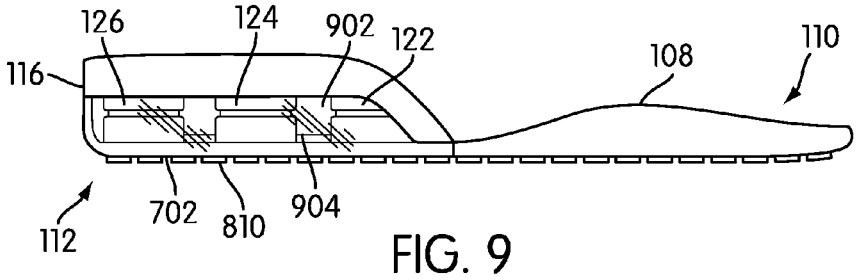
FIG. 9 is a schematic side view of a preferred embodiment of a sole.

Referring to FIGS. 8 and 9, perimeter wall 116 of heel portion 112 may also be substantially transparent. In particular, first side 804 of support member 118, including support columns 121, 123 and 125, are preferably visible through first side 802 of perimeter wall 116. Likewise, second side 904 of support member 118, including support columns 122, 124 and 126, are preferably visible through second side 902 of perimeter wall 116.

With this configuration, a substantial majority of support member 118 may be visible through heel portion 112. This is preferable over traditional designs that include enclosed support members or spring-like devices, which may only include windows or partial regions of visibility at the heel of the sole. Increased visibility of support member 118 provides greater aesthetic appeal over prior art designs.

Additionally, since outer bottom surface 702 is preferably completely transparent, the entirety of indicia member 120 may be visible through outer bottom surface 702. Because outer bottom surface 702 is large, comprising a majority of the area of the bottom of sole 108, in other embodiments different indicia members could be accommodated, including indicia members that are larger than indicia member 120. Thus, the current design is advantageous over prior art designs that may only include a small region for viewing indicia.

In a preferred embodiment, indicia member 120 has a light color. Using this arrangement, indicia member 120 will contrast well against cavity 114 (which may appear dark through outer bottom surface 702) and support member 118 that preferably has a distinct and darker color from indicia member 120. This preferred arrangement may highlight or 'spotlight' indicia member 120, which is useful to attract additional attention to a logo, for example. In other embodiments, any color for indicia member 120 and support member 118 may be used.

Preferably, sole 108 is configured to contact the ground. In some embodiments, sole 108 may include a tread system of some kind, including one or more ground engaging elements. In this embodiment, sole 108 may include ground engaging members 810 that extend from forefoot portion 110 to heel portion 112. In particular, ground engaging members 810 may be disposed on outer bottom surface 702 of heel portion 112.

Figure 10:
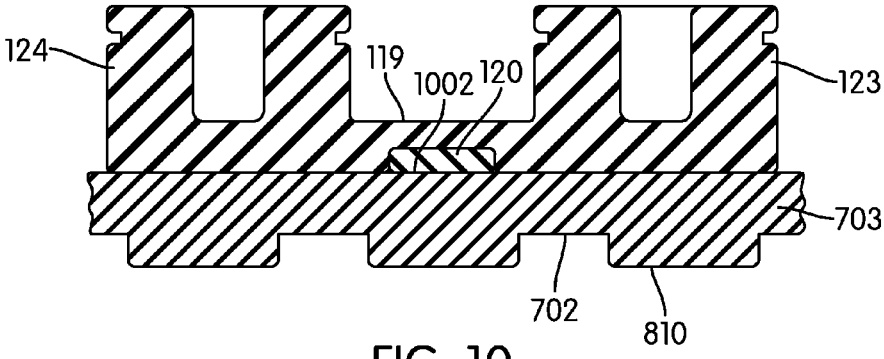
FIG. 10 is a close up cross sectional side view of a preferred embodiment of a heel portion of a sole.

FIG. 10 is a cross sectional view of a preferred embodiment of heel portion 112. In this embodiment, third support column 123, fourth support column 124 and a portion of indicia member 120 are preferably disposed over inner bottom surface 1002 of heel bottom 703. As previously mentioned, outer bottom surface 702 is preferably configured to contact the ground using ground engaging members 810. Ground engaging members 810 are preferably treads of some kind. In other embodiments, ground engaging members 810 could be cleats.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear, comprising:

a support member including a plurality of support columns, the support member being associated with a heel portion of the article of footwear;

wherein the support member includes a webbing member having an inner surface and an opposing outer surface;

wherein the outer surface of the webbing member includes an indicia recess having a pre-formed shape to match a corresponding indicia, wherein the recess has a substantially similar shape prior to receiving the indicia; and wherein the indicia member is disposed in the recess such that an outer surface of the indicia member is substantially coplanar with the outer surface of the webbing member.

2. The article of footwear according to claim 1, wherein the support member includes six support columns.

3. The article of footwear according to claim 1, wherein the indicia member overlaps with more than one of the plurality of support columns.

4. The article of footwear according to claim 1, wherein the ground engaging members are disposed on an outer bottom surface of the heel.

5. The article of footwear according to claim 1, wherein the indicia recess is associated with one of the plurality of support columns.

6. The article of footwear according to claim 1, wherein the indicia recess does not overlap with one of the plurality of support columns.

7. An article of footwear, comprising:

a sole including a forefoot portion and a heel portion, the heel portion including at least one ground engaging member;

a support member including a plurality of support columns disposed within an inner cavity of the heel portion;

wherein an outer bottom surface of the forefoot portion is substantially opaque and an outer bottom surface and a perimeter wall of the heel portion are substantially transparent;

wherein the support member further includes a webbing member, wherein the webbing member includes an indicia recess having a pre-formed shape to match a corresponding indicia, wherein the recess has a substantially similar shape prior to receiving the indicia; and wherein the indicia member is disposed in the recess such that an outer surface of the indicia member is substantially coplanar with the outer surface of the webbing member.

8. The article of footwear according to claim 7, wherein the support member includes a bottom side.

9. The article of footwear according to claim 8, wherein a substantial majority of the bottom side is visible through the outer bottom surface of the heel portion.

10. The article of footwear according to claim 7, wherein the support member includes a peripheral region including a medial side, a lateral side and a rear side.

11. The article of footwear according to claim 10, wherein a substantial majority of the peripheral region is visible through a periphery of the outer bottom surface of the heel portion.

12. The article of footwear according to claim 7, wherein the heel portion includes a plurality of ground engaging members.

13. An article of footwear, comprising:

a sole including a heel portion, the heel portion including a support member, an outer bottom surface and a perimeter wall, wherein the outer bottom surface and the perimeter wall are substantially transparent;

the sole further comprising a forefoot portion having an outer bottom surface that is substantially opaque;

an indicia member disposed within an indicia recess formed in the support member, wherein the indicia recess has a pre-formed shape to match a corresponding indicia, wherein the recess has a substantially similar shape prior to receiving the indicia, wherein the indicia is visible through the outer bottom surface; and wherein an outer surface of the indicia member is substantially coplanar with an outer surface of the support member.

14. The article of footwear according to claim 13, wherein the heel portion has a first length and the forefoot portion has a second length.

15. The article of footwear according to claim 14, wherein the first length is greater than the second length.

16. The article of footwear according to claim 13, wherein the support member including a plurality of support columns.

17. The article of footwear according to claim 16, wherein the indicia member is associated with one of the plurality of support columns.

18. The article of footwear according to claim 16, wherein the indicia member does not overlap with one of the plurality of support columns.

19. The article of footwear according to claim 13, wherein the outer bottom surface of the heel portion includes at least one ground engaging member.

20. The article of footwear according to claim 13, wherein the thickness of the indicia recess is substantially similar to the thickness of the indicia member.

* * * * *